US010632757B1

(12) United States Patent
Herrmann et al.

(10) Patent No.: US 10,632,757 B1
(45) Date of Patent: Apr. 28, 2020

(54) SYSTEM AND METHOD FOR ATTENUATING THE DRYING OF INK FROM A PRINTHEAD DURING IDLE PERIODS

(71) Applicant: Xerox Corporation, Norwalk, CT (US)

(72) Inventors: Douglas K. Herrmann, Webster, NY (US); Seemit Praharaj, Webster, NY (US); Michael J. Levy, Webster, NY (US); Jason M. LeFevre, Penfield, NY (US); Paul J. McConville, Webster, NY (US); Chu-heng Liu, Penfield, NY (US); Linn C. Hoover, Webster, NY (US); David VanKouwenberg, Avon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/214,673

(22) Filed: Dec. 10, 2018

(51) Int. Cl.
*B41J 2/175* (2006.01)
*B41J 2/165* (2006.01)

(52) U.S. Cl.
CPC ..... *B41J 2/17596* (2013.01); *B41J 2/17566* (2013.01)

(58) Field of Classification Search
CPC . B41J 2/17596; B41J 2/17566; B41J 2/16552
See application file for complete search history.

(56) References Cited

U.S. PATENT DOCUMENTS

| | | | |
|---|---|---|---|
| 4,296,418 A | 10/1981 | Yamazaki et al. | |
| 4,364,065 A | 12/1982 | Yamamori et al. | |
| 4,947,187 A | 8/1990 | Iwagami | |
| 5,394,178 A | 2/1995 | Grange | |
| 5,635,965 A | 6/1997 | Purwins et al. | |
| 5,936,647 A | 8/1999 | Rhodes et al. | |
| 5,980,622 A | 11/1999 | Byers | |
| 7,156,514 B2 | 1/2007 | Rosa | |
| 7,753,475 B2 | 7/2010 | Berry et al. | |
| 7,992,986 B2 | 8/2011 | Snyder et al. | |
| 8,592,503 B2 | 11/2013 | Bogale et al. | |
| 2003/0231222 A1 | 12/2003 | Jefferson et al. | |
| 2004/0066427 A1* | 4/2004 | West | B41J 2/16552 347/22 |
| 2008/0204501 A1 | 8/2008 | Kurita et al. | |
| 2009/0237424 A1 | 9/2009 | Martin et al. | |
| 2010/0073445 A1 | 3/2010 | Silverbrook et al. | |
| 2013/0215189 A1 | 8/2013 | Justice et al. | |

FOREIGN PATENT DOCUMENTS

| | | |
|---|---|---|
| EP | 1 827 839 B1 | 2/2009 |
| KR | 10-1397307 B1 | 5/2014 |
| WO | 2008-026417 A1 | 3/2008 |

OTHER PUBLICATIONS

Kwon et al.; Measurement of inkjet first-drop behavior using a high-speed camera; Review of Scientific Instruments; Mar. 2, 2016; vol. 87—Issue No. 3; AIP Publishing.

* cited by examiner

*Primary Examiner* — Jason S Uhlenhake
(74) *Attorney, Agent, or Firm* — Maginot Moore & Beck LLP

(57) ABSTRACT

An ink delivery system of an inkjet printer selectively injects flushing fluid into a supply tube for ink into a printhead to form a mixture of flushing fluid and ink prior to a period of inactivity for the printhead. The ratio of the flushing fluid to the ink is determined by a controller using environmental conditions, ink characteristics, and a duration for the period of inactivity.

16 Claims, 4 Drawing Sheets

SYSTEM AND METHOD FOR ATTENUATING THE DRYING OF INK FROM A PRINTHEAD DURING IDLE PERIODS

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

A prior art ink delivery system 20 used in inkjet imaging devices is shown in FIG. 4. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to selectively block the conduit 634. A valve 612 is also provided in the conduit 614 connecting an air pressure pump 616 to the ink reservoir 604 and this valve remains open except during purging operations.

When a new printhead is installed or its manifold needs to be flushed to remove air in the conduit 618, a manifold purge is performed. In a manifold purge, the controller 80 operates the valve 642 to enable fluid to flow from the manifold outlet to the waste ink tank 638, activates the air pressure pump 616, and operates the valve 612 to close the ink reservoir to atmospheric pressure so pump 616 can pressurize the ink in the ink reservoir 604. The pressurized ink flows through conduit 618 to the manifold inlet of printhead 608. Because valve 642 is also opened, the pneumatic impedance to fluid flow from the manifold to the inkjets is greater than the pneumatic impedance through the manifold. Thus, ink flows from the manifold outlet to the waste tank. The pressure pump 616 is operated at a predetermined pressure for a predetermined period of time to push a volume of ink through the conduit 618 and the manifold of the printhead 608 that is sufficient to fill the conduit 618, the manifold in the printhead 608, and the conduit 634 without completely exhausting the supply of ink in the reservoir. The controller then operates the valve 642 to close the conduit 634 and operates the valve 612 to vent the ink reservoir to atmospheric pressure. Thus, a manifold purge fills the conduit 618 from the ink reservoir to the printhead, the manifold, and the conduit 634 so the manifold and the ink delivery system are primed since no air is present in the conduits or the printhead. The ink reservoir is then resupplied to bring the height of the ink to a level where the distance between the level in the reservoir and the printhead inkjets is D, as previously noted.

To prime the inkjets in the printhead 608 following a manifold prime, the controller 80 closes the valve 612 and activates the air pressure pump 616 to pressurize the head space of the reservoir 604 to send ink to the printhead. Because the valve 642 is closed, the pneumatic impedance of the primed system through the manifold is greater than the pneumatic impedance through the inkjets so ink is urged into the inkjets. Again, the purge pressure is exerted at a predetermined pressure for a predetermined period of time to urge a volume of ink into the printhead that is adequate to fill the inkjets. Any ink previously in the inkjets is emitted from the nozzles in the faceplate 624 of the printhead 608. This ink purging primes the inkjets and can also help restore clogged and inoperative inkjets to their operational status. After the exertion of the pressure, the controller 80 operates the valve 612 to open and release pressure from the ink reservoir. A pressure sensor 620 is also operatively connected to the pressure supply conduit 622 and this sensor generates a signal indicative of the pressure in the reservoir. This signal is provided to the controller 80 for regulating the operation of the air pressure pump. If the pressure in the reservoir during purging exceeds a predetermined threshold, then the controller 80 operates the valve 612 to release pressure. If the pressure in the reservoir drops below a predetermined threshold during purging, then the controller 80 operates the pressure source 616 to raise the pressure. The two predetermined thresholds are different so the controller can keep the pressure in the reservoir in a predetermined range during purging rather than at one particular pressure.

Some inkjet imaging devices use inks that change from a low viscosity state to a high viscosity state relatively quickly. When the time between print jobs or a scheduled period printer inactivity exceeds some duration, solvent, such as water, evaporates from the ink. As the viscosity of the ink increases from this evaporation, the ink begins to adhere to the bore of the nozzles in the inkjets and the inkjets can become clogged. Although the controller 80 can perform a purging operation to purge the high viscosity ink from the inkjets and bring fresh ink into the inkjets of the printhead, this purging operation can waste ink otherwise available for printing. Reducing the need for frequent purging with quickly drying inks would be beneficial.

SUMMARY

A method of inkjet printer operation enables ink within a printhead to maintain a low viscosity state during extended periods of inactivity. The method includes operating with a controller a first valve to connect selectively a source of flushing fluid to a tube that provides ink from an ink reservoir to a printhead and operating with the controller a pump to deliver flushing fluid from the source of flushing fluid to the tube to mix with ink from the ink reservoir to form a volume of a mixture of flushing fluid and ink that is provided to the printhead and that corresponds to a capacity of the printhead to hold ink.

An ink delivery system implements the method that enables ink within a printhead to maintain a low viscosity state during extended periods of inactivity. The ink delivery system includes an ink reservoir operatively connected by a tube to a printhead to provide ink through the tube to the printhead, a source of flushing fluid, a first valve in the tube, the first valve being configured to connect the source of flushing fluid to the tube selectively and the first valve being positioned between the ink reservoir and the printhead, a pump operatively connected between the first valve and the source of flushing fluid to deliver flushing fluid to the tube at the first valve, and a controller operatively connected to the first valve and the pump. The controller is configured to operate the first valve selectively to connect the source of flushing fluid to the tube and to operate the pump to deliver flushing fluid to the tube to mix with ink from the ink reservoir to form a volume of a mixture of flushing fluid and ink that is provided to the printhead and that corresponds to a capacity of the printhead to hold ink.

An inkjet printer uses the delivery system to implement the method that enables ink within a printhead to maintain a low viscosity state during extended periods of inactivity. The printer includes a plurality of printheads and an ink delivery system operatively connected to one of the printheads in the plurality of printheads in a one-to-one correspondence. Each ink delivery system includes an ink reservoir operatively connected by a tube to a printhead to provide ink through the tube to the printhead, a source of flushing fluid, a first valve in the tube, the first valve being configured to connect the source of flushing fluid to the tube selectively and the first valve being positioned between the ink reservoir and the printhead, a pump operatively connected between the first valve and the source of flushing fluid to deliver flushing fluid to the tube at the first valve, and a controller operatively connected to the first valve and the pump. The controller is configured to operate the first valve selectively to connect the source of flushing fluid to the tube and to operate the pump to deliver flushing fluid to the tube to mix with ink from the ink reservoir to form a volume of a mixture of flushing fluid and ink that is provided to the printhead and that corresponds to a capacity of the printhead to hold ink.

BRIEF DESCRIPTION OF THE DRAWINGS

The foregoing aspects and other features of a system and method that enable ink within a printhead to maintain a low viscosity state during periods of extended inactivity are explained in the following description, taken in connection with the accompanying drawings.

DETAILED DESCRIPTION

Figure 1:
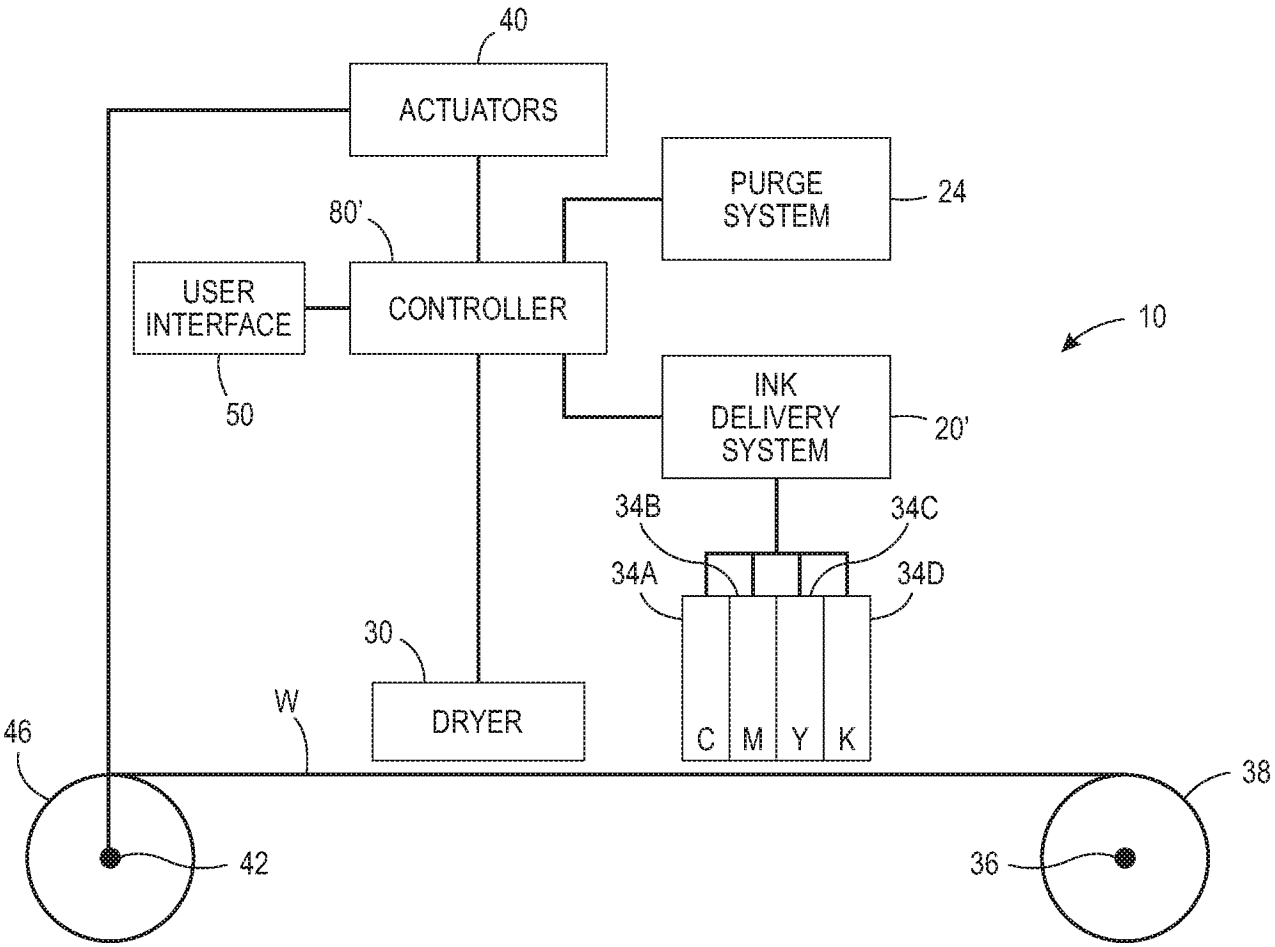
FIG. 1 is a schematic drawing of an aqueous inkjet printer that prints images on media sheets and preserves the low viscosity of fast drying inks in the printheads of the printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. Also, the description presented below is directed to a system for operating inkjets in an inkjet printer to reduce evaporation of ink at the nozzles of the inkjets in the printer. The reader should also appreciate that the principles set forth in this description are applicable to similar imaging devices that generate images with pixels of marking material.

FIG. 1 illustrates a high-speed aqueous ink image producing machine or printer 10 in which a controller 80' has been configured to perform the process 400 described below to operate the ink delivery system 20' (FIG. 2) so the ink at the nozzles of the printheads 34A, 34B, 34C, and 34D does not dry out during periods of inactivity. As illustrated, the printer 10 is a printer that directly forms an ink image on a surface of a web W of media pulled through the printer 10 by the controller 80' operating one of the actuators 40 that is operatively connected to the shaft 42 to rotate the shaft and the take up roll 46 mounted about the shaft. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction.

The aqueous ink supply subsystem 20' has at least one ink reservoir containing one color of aqueous ink. Since the illustrated printer 10 is a multicolor image producing machine, the ink delivery system 20' includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules, as described with reference to the process 400 below, to attenuate evaporation of the ink from the printheads. Additionally, although not shown in FIG. 1, each printhead in a printhead module is connected to a corresponding waste ink tank with a valve as described previously with reference to FIG. 6 to enable the manifold and inkjet purge operations previously described. The printhead modules 34A-34D can include associated electronics for operation of the one or more printheads by the controller 80' although those connections are not shown to simplify the figure. Although the printer 10 includes four printhead modules 34A-34D, each of which has two arrays of printheads, alternative configurations include a different number of printhead modules or arrays within a module.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by the controller 80' operating one or more actuators 40 to rotate the shaft 42 on which the take up roll 46 is placed to pull the web from the media roll 38 as it rotates with the shaft 36. When the web is completely printed, the take-up roll can be removed from the shaft 42. Alternatively, the printed web can be directed to other processing stations (not shown) that perform tasks such as cutting, collating, binding, and stapling the media.

Operation and control of the various subsystems, components and functions of the machine or printer 10 are performed with the aid of a controller or electronic subsystem (ESS) 80'. The ESS or controller 80' is operably connected to the components of the ink delivery system 20', the purge system 24, the printhead modules 34A-34D (and thus the printheads), the actuators 40, and the heater 30. The ESS or controller 80', for example, is a self-contained, dedicated mini-computer having a central processor unit (CPU) with electronic data storage, and a display or user interface (UI) 50. The ESS or controller 80', for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80' is the main multi-tasking processor for operating and controlling all of the other machine subsystems and functions, including the printing process.

The controller 80' can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80' from either a scanning system or an online or work station connection for processing and generation of the printhead control signals output to the printhead modules 34A-34D. Additionally, the controller 80' determines and accepts related subsystem and component controls, for example, from operator inputs via the user interface 50, and accordingly executes such controls. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 2:
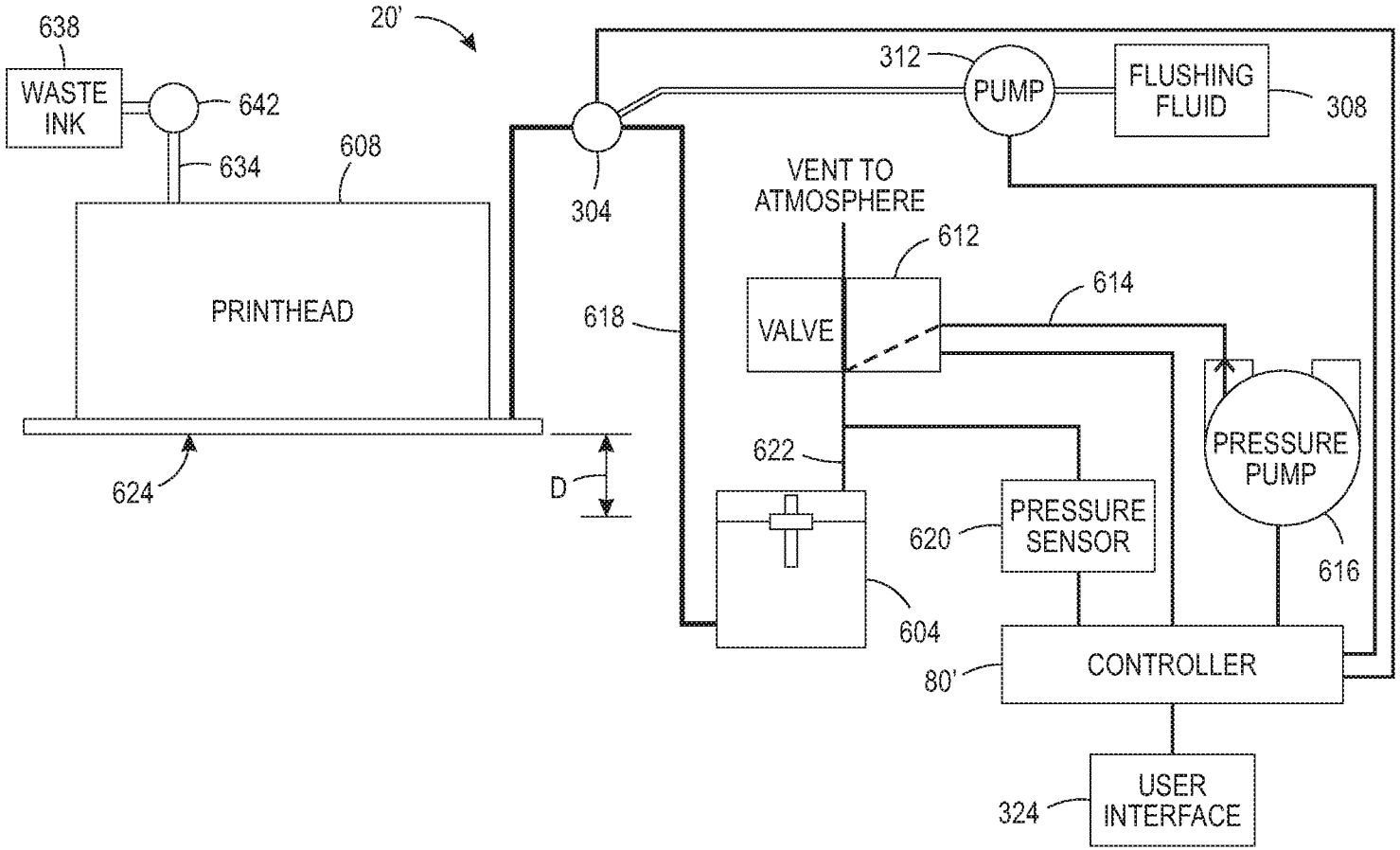
FIG. 2 is a schematic diagram of an ink delivery system that is used in the printer shown in FIG. 1 to prevent low viscosity inks in the printheads of the printer from drying out during periods of extended inactivity.

Using like numbers for like components, an ink delivery system that can attenuate the evaporation of quickly drying inks from printheads is shown in FIG. 2. This system 20' differs from the one shown in FIG. 4 by the addition of a mixing valve 304 in the supply line 618 between the ink reservoir 604 and the printhead 608, the connection of a supply of flushing fluid 308 to the mixing valve 304, and a pump 312 for delivering flushing fluid from the supply 308 to the valve 304. Additionally, the controller 80' is operatively connected to the pump 312 and the valve 304 and is configured to perform the process 400 shown in FIG. 3 prior to periods of inactivity to dilute the ink supplied to the printhead with the flushing fluid to preserve the low viscosity of ink within the printhead supplied by the ink reservoir 604. The flushing fluid can be any fluid that is used for flushing aqueous ink from printheads, such as Dupont KF200 available from DowDupont of Wilmington, Del. Water could be used as a flushing fluid in aqueous ink printing systems but it evaporates more quickly than most fluids used to flush aqueous ink from printheads. In printers that use UV aqueous ink other fluids typically used to flush UV aqueous ink would be used to accommodate the different characteristics of those inks. The mixing valve 304 is positioned in the supply line 618 at a location not far from the printhead 608 to reduce the amount of ink that needs to be diluted with the flushing fluid and supplied to the printhead. As the controller 80' operates the pump 312 to inject flushing fluid into the mixing valve 304, it also operates the air pressure source 616 to pressurize the ink reservoir 604 to purge the undiluted ink from the printhead so it can be replaced by the ink/flushing fluid mixture. Alternatively, the controller 80' could operate all of the inkjets in the printhead repeatedly to deplete the ink in the printhead to enable its refilling with the ink diluted with the flushing fluid.

In one embodiment, the supply line 618 is a tube having an 8 mm diameter with a lumen having a diameter of 5 mm. A purge of the printhead removes 5 to 7 ml of ink from the printhead so a 50% mixture of ink and flushing fluid requires approximately 3 ml of flushing fluid in the ink replacing the purged ink. Accordingly, the valve 304 is placed approximately 140 mm from the printhead. This position means the volume of the lumen in the tube from the valve 304 to the printhead is approximately the same as the volume of ink that the printhead holds. The controller 80' is configured to identify an appropriate ratio for diluting the ink using the environmental conditions at the printhead, such as temperature and humidity; characteristics of the ink, such as viscosity and color; the length of the period of inactivity; and the like. The higher the flushing fluid in ratio, the longer the ink viscosity is preserved. That is, a ratio of 75% flushing fluid to 25% ink preserves the low viscosity of the ink longer than a ratio of 25% flushing fluid to 75% ink. Additionally, the user interface 50 is provided so an operator can identify a ratio for the mixture and the controller 80' receives the identified ratio and uses it to operate the pump for injecting the flushing fluid into the supply line.

Figure 3:
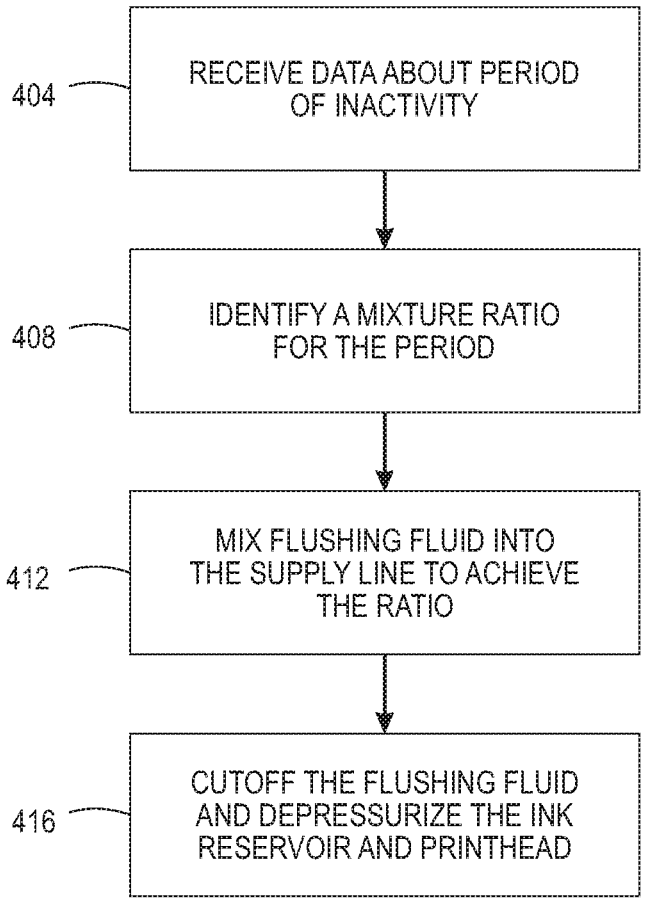
FIG. 3 is a flow diagram of a process for operating the ink delivery system of the printer of FIG. 1.
Figure 4:
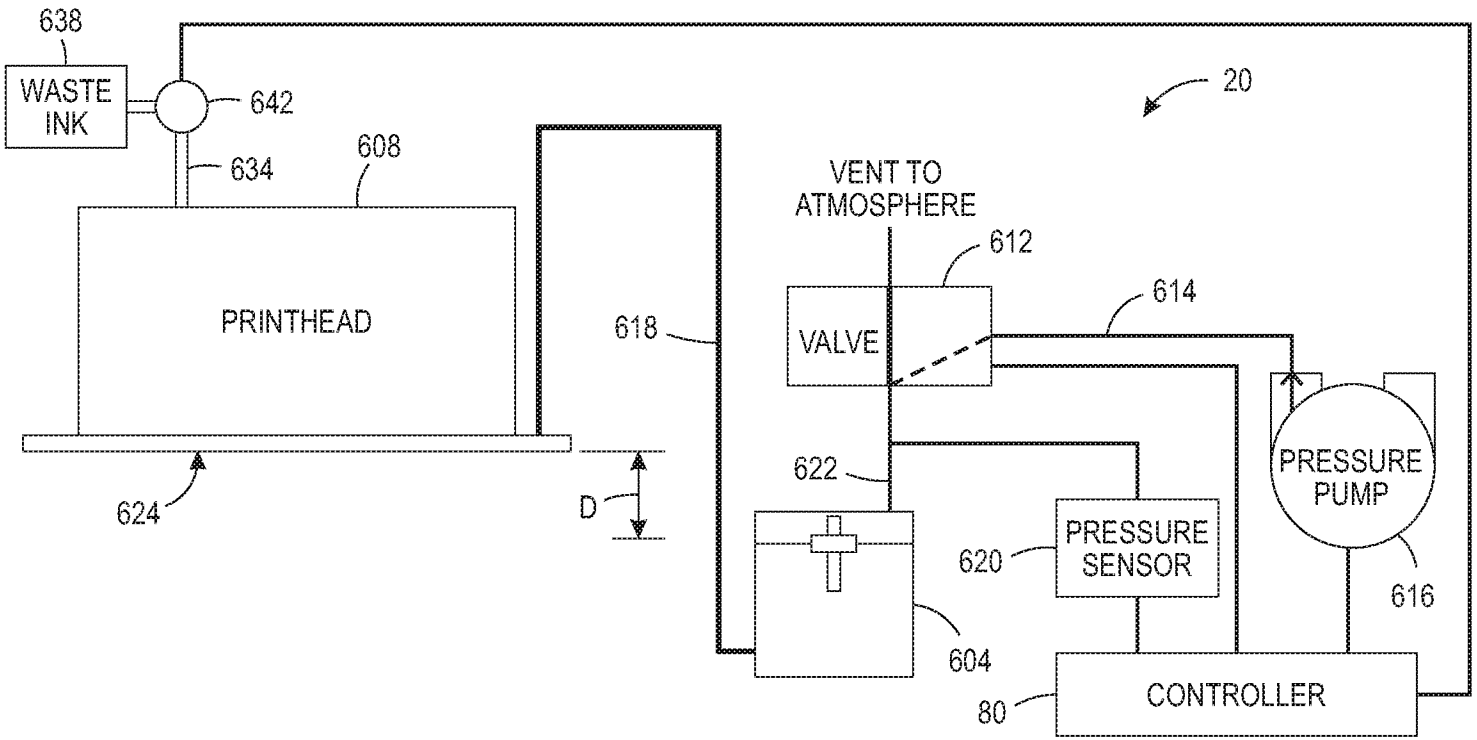
FIG. 4 PRIOR ART
FIG. 4 is a schematic diagram of an ink delivery system that is used in prior art printers for purging only.

FIG. 3 depicts a flow diagram for the process 400 that operates the ink delivery system 20' to dilute the ink being supplied to the printhead 608 with flushing fluid at a ratio effective for preserving the low viscosity of the ink within the printhead during periods of inactivity. In the discussion below, a reference to the process 400 performing a function or action refers to the operation of a controller, such as controller 80', to execute stored program instructions to perform the function or action in association with other components in the printer. The process 400 is described as being performed by an ink delivery system 20' in the printer 100 of FIG. 1 for illustrative purposes.

The process 400 begins with the controller receiving data from the user interface indicating the printer will enter a period of inactivity of a specified duration (block 404). The controller then determines an appropriate ink/flushing fluid ratio for the ink being delivered to the printhead, the environmental conditions, and the identified period of inactivity duration (block 408). The controller then operates the air pressure pump 616 to start a purge of a corresponding volume of ink from the printhead while operating the valve 304 and the pump 312 to supply the flushing fluid to the supply line 618 in an amount to achieve the identified ratio for the volume of ink replacing the purged ink (block 412). When the appropriate amount of flushing fluid has been added to the ink being supplied to the printhead so the ink within the printhead is at the identified ratio, the controller 80' operates the valve 304 to disconnect the flushing fluid supply from the supply line 618 and deactivates the air pressure pump 616 and the pump 312 (block 416). The ink/flushing fluid mixture in the printhead keeps the ink from drying during the period of inactivity. When the printhead is returned to operational status, the controller operates the pump 616 to purge the printhead of the ink/flushing fluid ratio and replenish the printhead with 100% ink. Thus, purge to return the printhead to operation does not need to waste the larger volume of ink that would be required to dissolve dried ink in a printhead and restore the inkjets in the printhead to operational status.

FIG. 2 shows one ink delivery system 20' configured to supply ink to a single printhead. In such embodiments, an ink delivery system can be provided for each printhead in the printer in a one-to-one correspondence. Thus, multiple ink delivery systems can be configured to supply a mixture of ink and flushing fluid to different printheads in a printhead module. The ink delivery systems are operated prior to periods of inactivity to prepare the printheads for inactivity and substantially reduce the risk of the ink in the printheads drying.

While the use of flushing fluid to preserve the viscosity of ink has been discussed above with reference to aqueous ink printing systems, flushing fluid could be used in other types of ink printing systems provided the ink at the nozzles does not transition its phase. For example, flushing fluids would be useful in solid ink systems as the ink at the nozzles transitions to the solid state as a result of temperature change and not evaporation at the nozzles. As noted previously, a flushing fluid compatible with UV aqueous inks could be used with printheads that eject UV aqueous ink drops.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink delivery system in a printer comprising:

an ink reservoir operatively connected by a tube to a printhead to provide ink through the tube to the printhead;

a source of flushing fluid;

a first valve in the tube, the first valve being configured to connect the source of flushing fluid to the tube selectively and the first valve being positioned between the ink reservoir and the printhead;

a pump operatively connected between the first valve and the source of flushing fluid to deliver flushing fluid to the tube at the first valve;

an air pressure pump operatively connected to the ink reservoir, the air pressure pump being configured to apply pressure to ink in the ink reservoir and the printhead;

a second valve operatively connected between the ink reservoir and the air pressure pump, the second valve being configured to be moved to a first position where the ink reservoir is vented to atmosphere pressure and to a second position where the air pressure pump is connected to the ink reservoir to apply pressure to the ink reservoir; and a controller operatively connected to the first valve, the second valve, and the pump, the controller being configured to:

operate the first valve selectively to connect the source of flushing fluid to the tube;

operate the pump to deliver flushing fluid to the tube to mix with ink from the ink reservoir to form a volume of a mixture of flushing fluid and ink that is provided to the printhead and that corresponds to a capacity of the printhead to hold ink; and operate the second valve to connect the air pressure pump to the ink reservoir to apply pressure to the ink in the ink reservoir and printhead to purge a volume of ink from the printhead that corresponds to the volume of the mixture of flushing fluid and ink so the volume of the mixture replaces the purged volume of ink.

2. The ink delivery system of claim 1, the controller being further configured to operate the second valve to disconnect the air pressure pump from the ink reservoir and vent the ink reservoir to atmospheric pressure after the volume of the mixture of flushing fluid and ink has filled the printhead so the volume of the mixture remains in the printhead.

3. The ink delivery system of claim 2, the controller being further configured to identify a ratio of the ink to the flushing fluid in the volume of the mixture and to operate the first valve, the second valve, the air pressure pump, and the pump using the identified ratio.

4. The ink delivery system of claim 3, the controller being further configured to identify the ratio by using environmental conditions, characteristics of the ink, and a length of time for a period of inactivity.

5. The ink delivery system of claim 4 wherein a volume of the tube between the first valve and the printhead corresponds to a volume of a capacity of the printhead to hold ink.

6. The ink delivery system of claim 2 further comprising:

a user interface; and the controller is operatively connected to the user interface, the controller is further configured to receive a ratio of the ink to the flushing fluid in the volume of the mixture from the user interface and to operate the first valve, the second valve, the air pressure pump, and the pump using the identified ratio.

7. The ink delivery system of claim 1, the controller being further configured to operate inkjets in the printhead to displace a volume of ink from the printhead that corresponds to the volume of the mixture.

8. A method for operating an ink delivery system in a printer comprising:

operating with a controller a first valve to connect selectively a source of flushing fluid to a tube that provides ink from an ink reservoir to a printhead;

operating with the controller a pump to deliver flushing fluid from the source of flushing fluid to the tube to mix with ink from the ink reservoir to form a volume of a mixture of flushing fluid and ink that is provided to the printhead and that corresponds to a capacity of the printhead to hold ink;

operating with the controller a second valve to:

connect an air pressure pump to the ink reservoir to apply pressure to the ink in the ink reservoir and printhead to purge a volume of ink from the printhead that corresponds to the volume of the mixture of flushing fluid and ink so the volume of the mixture replaces the purged volume of ink; and disconnect the air pressure pump from the ink reservoir and vent the ink reservoir to atmospheric pressure after the volume of the mixture of flushing fluid and ink has filled the printhead so the volume of the mixture remains in the printhead.

9. The method of claim 8 further comprising:

operating with the controller inkjets in the printhead to displace a volume of ink from the printhead that corresponds to the volume of the mixture.

10. The method of claim 8 further comprising:

identifying with the controller a ratio of the ink to the flushing fluid in the volume of the mixture; and operating with the controller the first valve, the second valve, the air pressure pump, and the pump using the identified ratio.

11. The method of claim 10 further comprising:

identifying with the controller the ratio by using environmental conditions, characteristics of the ink, and a length of time for a period of inactivity.

12. The method of claim 11 wherein a volume of the tube between the first valve and the printhead corresponds to a volume of a capacity of the printhead to hold ink.

13. The method of claim 8 further comprising:

receiving with the controller from a user interface a ratio of the ink to the flushing fluid in the volume of the mixture from the user interface and to operate the first valve, the second valve, the air pressure pump, and the pump using the identified ratio.

14. A printer comprising:

a plurality of printheads;

an ink delivery system operatively connected to one of the printheads in the plurality of printheads in a one-to-one correspondence, each ink delivery system comprising:

an ink reservoir operatively connected by a tube to a printhead to provide ink through the tube to the printhead;

a source of flushing fluid;

a first valve in the tube, the first valve being configured to connect the source of flushing fluid to the tube selectively and the first valve being positioned between the ink reservoir and the printhead;

a pump operatively connected between the first valve and the source of flushing fluid to deliver flushing fluid to the tube at the first valve;

an air pressure pump operatively connected to the ink reservoir, the air pressure pump being configured to apply pressure to ink in the ink reservoir and the printhead;

a second valve operatively connected between the ink reservoir and the air pressure pump, the second valve being configured to be moved to a first position where the ink reservoir is vented to atmosphere pressure and to a second position where the air pressure pump is connected to the ink reservoir to apply pressure to the ink reservoir;

a controller operatively connected to the first valve, the second valve, and the pump, the controller being configured to:

operate the first valve selectively to connect the source of flushing fluid to the tube;

operate the pump to deliver flushing fluid to the tube to mix with ink from the ink reservoir to form a volume of a mixture of flushing fluid and ink that is provided to the printhead and that corresponds to a capacity of the printhead to hold ink operate the second valve to connect the air pressure pump to the ink reservoir to apply pressure to the ink in the ink reservoir and printhead to purge a volume of ink from the printhead that corresponds to the volume of the mixture of flushing fluid and ink so the volume of the mixture replaces the purged volume of ink.

15. The printer of claim 14, the controller being further configured to operate the second valve to disconnect the air pressure pump from the ink reservoir and vent the ink reservoir to atmospheric pressure after the volume of the mixture of flushing fluid and ink has filled the printhead so the volume of the mixture remains in the printhead.

16. The printer of claim 15, the controller being further configured to identify a ratio of the ink to the flushing fluid in the volume of the mixture and to operate the first valve, the second valve, the air pressure pump, and the pump using the identified ratio.

* * * * *